US005104368A

United States Patent [19]

Arbuthnot

[11] Patent Number: 5,104,368

[45] Date of Patent: Apr. 14, 1992

[54] CARTON SET-UP MACHINE

[76] Inventor: E. Neil Arbuthnot, P.O. Box 652, Lake Alfred, Fla. 33850

[21] Appl. No.: 513,502

[22] Filed: Apr. 24, 1990

[51] Int. Cl.[5] ..... B31B 7/00; B31B 13/00

[52] U.S. Cl. ..... 493/100; 493/8; 493/18; 493/84; 493/94

[58] Field of Search ..... 493/8, 18, 29, 30, 34, 493/94, 100, 309, 318, 319, 906, 907, 84, 89, 110

[56] References Cited

U.S. PATENT DOCUMENTS

| | | | |
|---|---|---|---|
| 2,971,442 | 2/1961 | Engleson et al. | 93/12 |
| 3,421,283 | 1/1969 | Schieser . | |
| 3,432,984 | 3/1969 | Bivans | 53/120 |
| 3,523,400 | 8/1970 | Daily | 53/117 |
| 3,821,874 | 10/1972 | Jones | 53/27 |
| 4,009,646 | 3/1977 | Mott | 93/36.01 |
| 4,137,830 | 10/1977 | Boyd | 493/8 |
| 4,142,453 | 11/1977 | Gidewall et al. | 493/100 |
| 4,237,777 | 8/1978 | Nowacki et al. | 493/100 |
| 4,300,327 | 11/1981 | Bridger | 53/258 |
| 4,650,448 | 3/1987 | Urso | 493/110 X |
| 4,835,944 | 11/1987 | Herrin | 493/906 |
| 4,842,125 | 6/1989 | Besemann | 198/457 |

*Primary Examiner*—Bruce M. Kisliuk
*Assistant Examiner*—John A. Marlott

[57] ABSTRACT

A machine and method for setting up cartons by inserting the bottoms of the cartons into the tops of the cartons consists of first and second parallel ramp portions onto which the respective sections of the carton are fed. Laterally adjustable vertical guides are located on the outer portions of the ramp portions to maintain proper orientation of carton sections as they slide down the ramp portions. The ramp portions terminate at respective backstops which limit further movement of carton sections. A pneumatically operated pusher, responsive to limit switches located in the backstops, inserts the bottom carton section into the top carton section and subsequently pushes the set-up carton off from the machine only when the limit switches indicate that both carton sections are properly positioned against the backstops. The pusher portion is supported by a sliding side guide which also acts as a stop for preventing incoming cartons from reaching the set-up area until the pusher is fully withdrawn.

19 Claims, 5 Drawing Sheets

CARTON SET-UP MACHINE

BACKGROUND OF THE INVENTION

The present invention relates to a carton set-up machine, and more particularly to a machine that automatically inserts a bottom of a carton sideways into a top of a carton.

In the packaging of certain types of materials such as fresh citrus fruit, peaches, or apples, it is desirable to store and ship the cartons in which the material is to be shipped with the bottom of the carton inserted sideways into the top so that the carton can be stored or shipped as a unit. Setting-up cartons in this manner saves space and shipping time, and assures that every carton will constitute a complete unit.

Although such carton set-up operations could be performed manually, considerable time and expense can be saved if the operation is performed automatically. Several machines have heretofore been designed which automatically insert a member into a carton. An example of such a machine can be found in U.S. Pat. No. 4,237,777, which discloses a machine for producing double-walled containers by inserting single-walled containers into blanks to form double-walled containers.

The above-described machine has the disadvantage of requiring many moving parts to properly align the respective sections of the container. These parts include a first movable arm for holding the blank in place, and a plurality of oscillating guide arms which insure that the respective members are properly aligned when the container is assembled. The relative complexity of the machine makes it too expensive for many applications. Furthermore, the complex operation increases the chance of misshaped container sections jamming the machine, which would require that the machine be shut down for manual removal of the jammed containers. Furthermore, prior-art set-up machines lack sufficient means for assuring that the carton sections are properly aligned before any actual operation of the machine commences, thereby increasing the chances of jamming the machines and damaging the carton sections.

SUMMARY OF THE INVENTION

It is therefore an object of the invention to provide a machine for setting-up cartons which is relatively simple in structure and operation, which avoids jamming due to misshaped carton sections, and which does not require manual intervention to remove jammed cartons.

According to one aspect of the invention, the set-up machine consists of first and second parallel ramp portions which are juxtaposed next to one another and each of which has a first longitudinal end onto which one of the carton sections enter. Guide members are located on the ramp portions between the first and second ends for maintaining the proper orientation of the first and second carton sections as they move down the first and second ramp portions towards the second ends thereof. Backstop means located at the second ends of the ramp portions prevent further movement of the carton sections. Sensor means are operable to determine whether the first and second carton sections are properly positioned for a carton set-up operation, and a control means actuates the pusher means to perform a carton set-up operation only when the sensor means detect that both the first and second carton sections are properly positioned.

The pusher means according to this aspect of the invention may consist of a cylinder located above the ramp portion and extending transversely past the outside lateral edge of the first ramp portion. A sliding piston extends from the end of the cylinder and is connected to a pusher which functions to insert the first carton section into the second carton section.

The pusher means may, in addition, comprise a side guide member which is connected to the pusher at the outer longitudinal edge thereof and which is slidably supported on cam rollers. The side guide member functions to support the pusher and to act as a stop to prevent any carton sections from entering the second end ramp portions until the piston is fully withdrawn.

Another object of this invention is to provide a method of setting-up cartons having first carton sections and second carton sections.

According to this aspect of the invention, first and second carton sections are introduced onto first longitudinal ends of first and second parallel ramp portions which are juxtaposed next to one another, and the respective carton sections are guided down the ramp portions to second end portions thereof. The inventive method further comprises stopping the carton sections when they reach the respective end portions of the ramps, and actuating a pusher means only when it is detected that both carton sections have reached the second end portions of the ramp portions.

BRIEF DESCRIPTION OF THE DRAWINGS

Further details are explained below with the aid of the illustrated exemplary embodiment illustrated in the attached drawings in which.

DETAILED DESCRIPTION OF THE PREFERRED EMBODIMENTS

Figure 1:
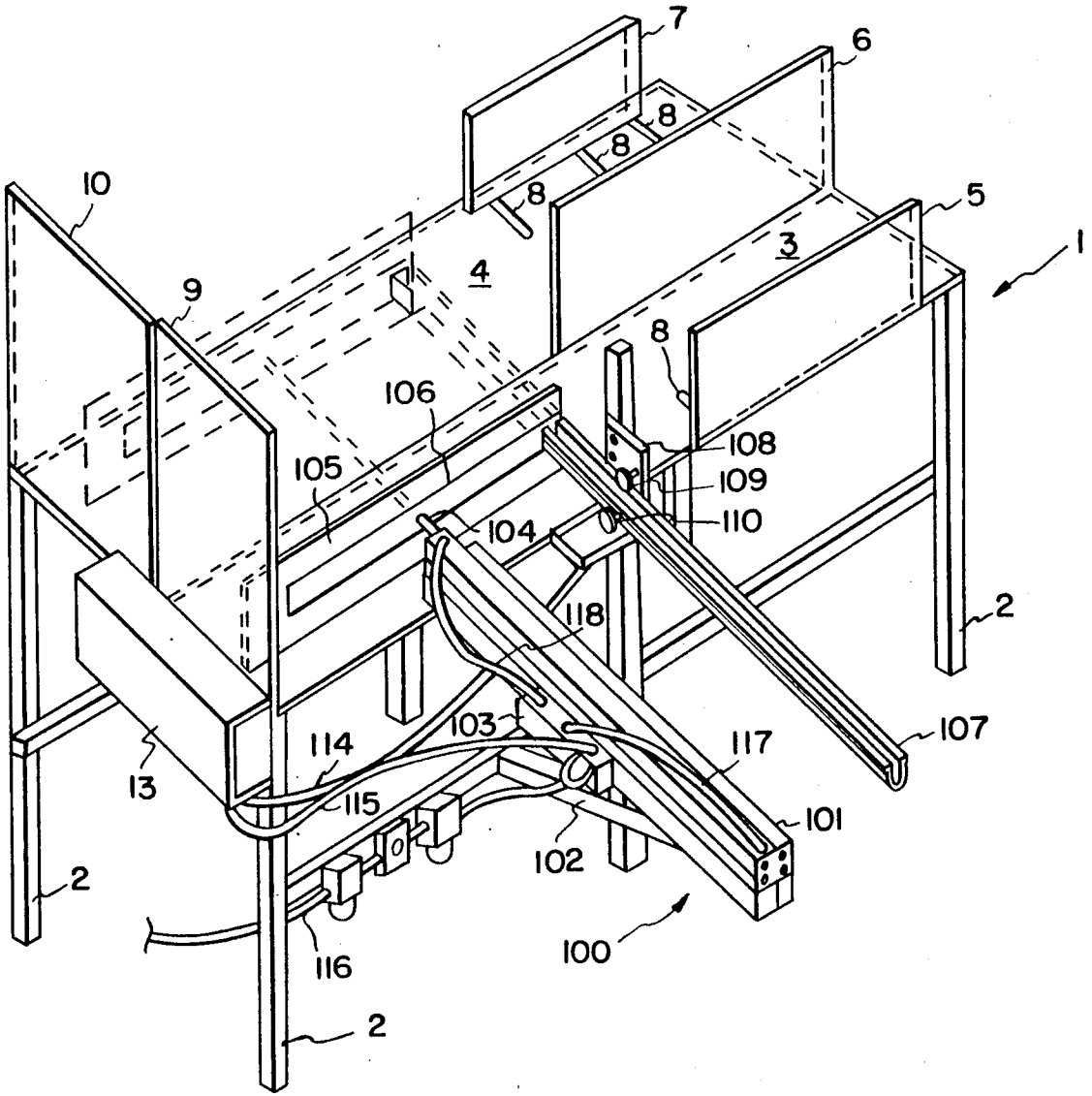
FIG. 1 is a perspective view of an embodiment of a carton set-up machine according to the present invention.

The preferred embodiment of a carton set-up machine according to the invention is shown in FIGS. 1–4. This machine is operable to insert a bottom of a carton such as a citrus carton into a top thereof and to subsequently discharge the thus assembled carton therefrom. FIG. 5 illustrates the bottom and top sections 200 and 202, respectively, of a citrus carton in their unassembled conditions. The carton is assembled by inserting the upright bottom section 200 into the open top section 202, which is lying on its side with its open top facing the side of the bottom section 200.

According to FIGS. 1–4, the carton set-up machine 1 comprises legs 2 which support the machine at a height at or below that of first and second infeed conveyors (not shown). The machine consists of first and second parallel ramp portions 3 and 4 juxtaposed next to one another and which terminate at respective backstops 9 and 10. The ramp portions may be slightly sloped from the first longitudinal ends towards their second longitudinal ends terminating at the backstops 9 and 10 and are preferably made of a relatively low-friction material, e.g. sheet metal. The surface should be smooth enough to allow objects to slide the entire length thereof without an undue amount of force or momentum being supplied thereto. The first and second ramp portions are separated by a vertical center guide member 6 rigidly attached to the machine intermediate the two ramp portions.

Vertical guide members 5 and 7 are positioned on the machine toward the outside lateral edges of ramp portions 3 and 4 and function to guide the carton sections being fed onto the machine so that they remain parallel with one another. These guide members are bolted to the machine through slots 8 in the ramp portions, extending transversely to the longitudinal direction of the ramp portions. The guide members 5 and 7 thus define effective widths of respective ramp portions 3 and 4 which are approximately equal to the widths of the respective carton sections 200 and 202. The effective width of the ramp portions can be varied by simply moving the guide members along slots 8. The set-up machine can thus be easily adjusted to accommodate cartons of varying sizes.

Figure 2:
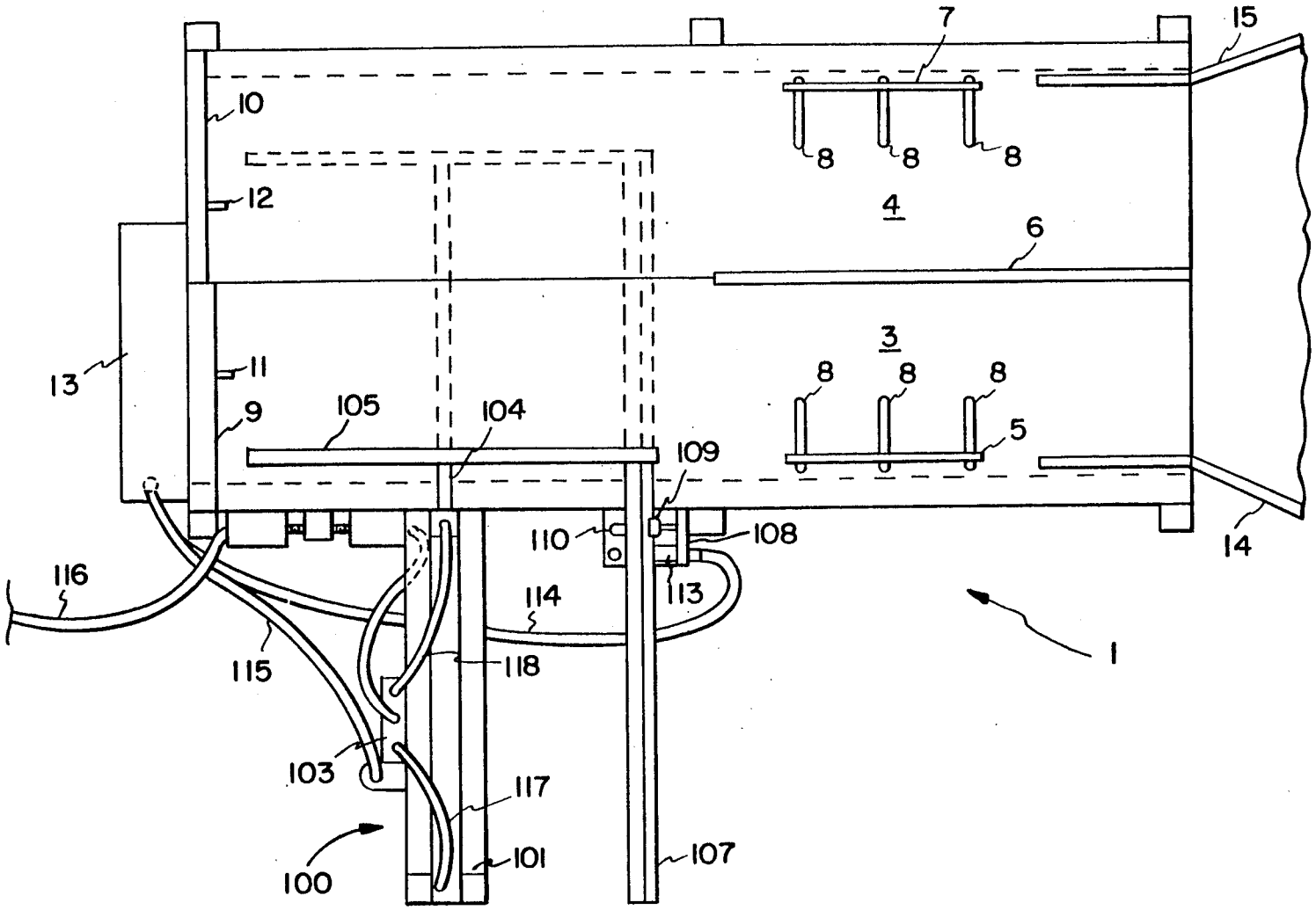
FIG. 2 is a top view of the machine shown in FIG. 1.
Figure 3:
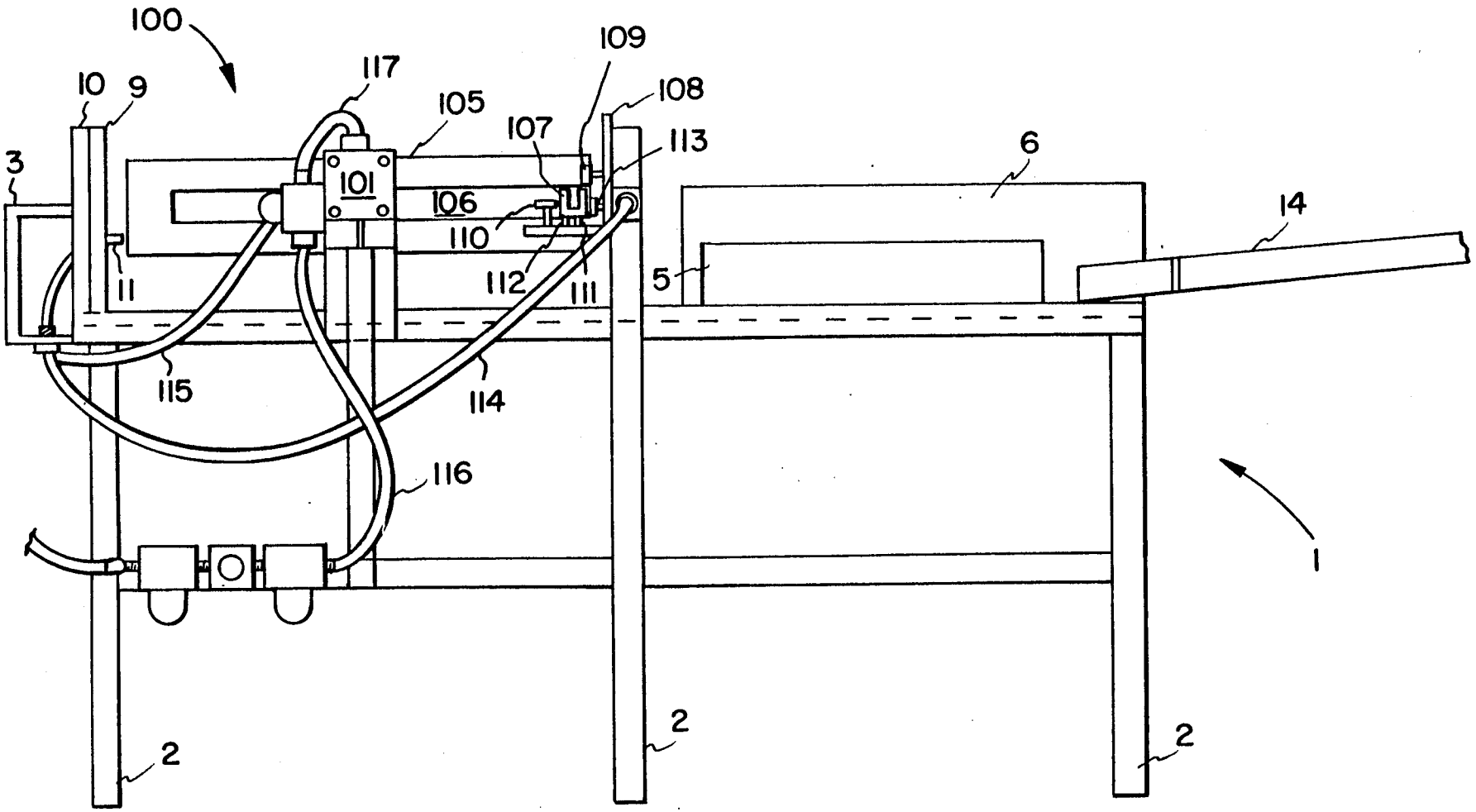
FIG. 3 is a front view of the machine shown in FIG. 1.
Figure 4:
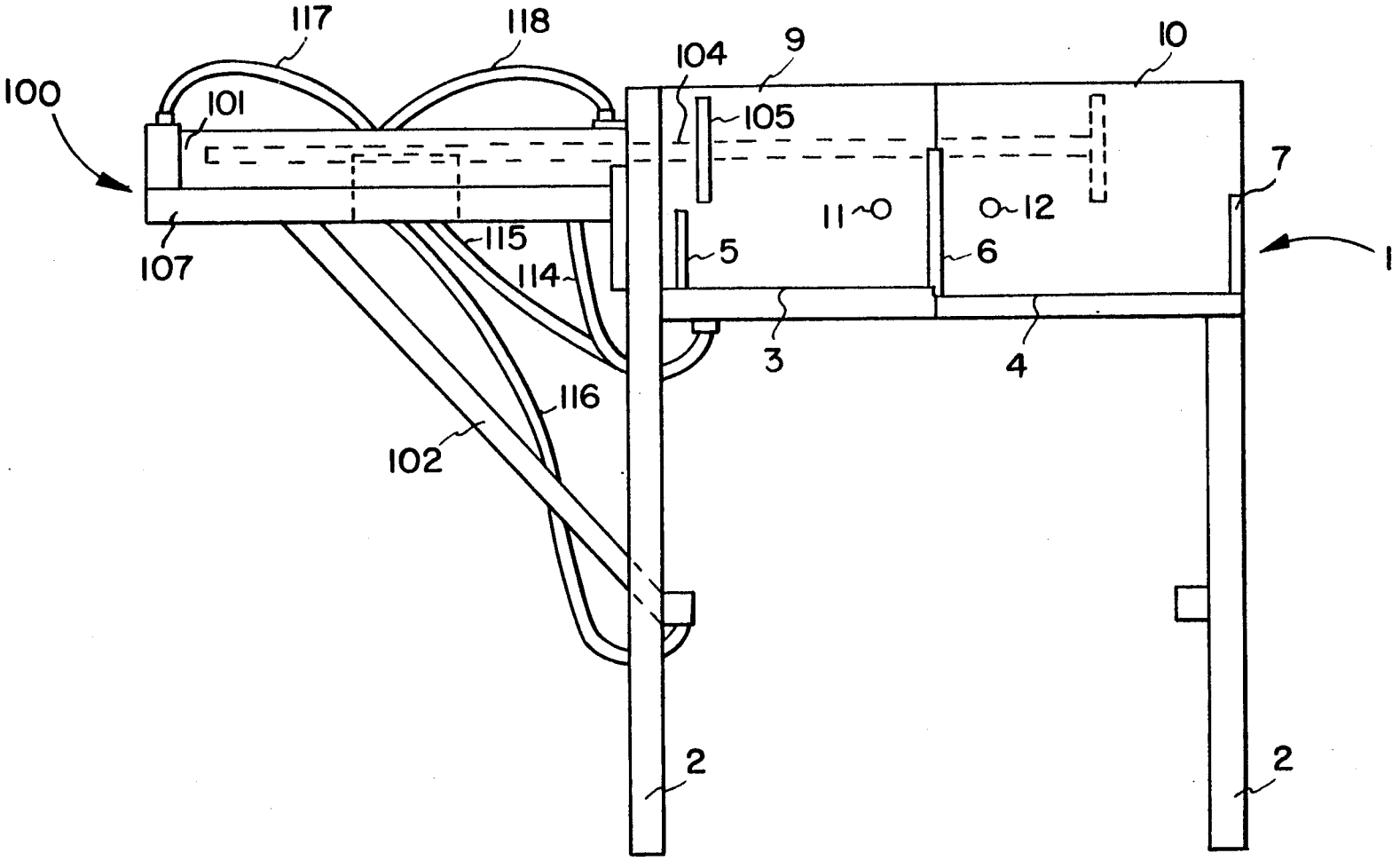
FIG. 4 is a side view of the machine shown in FIG. 1.
Figure 5:
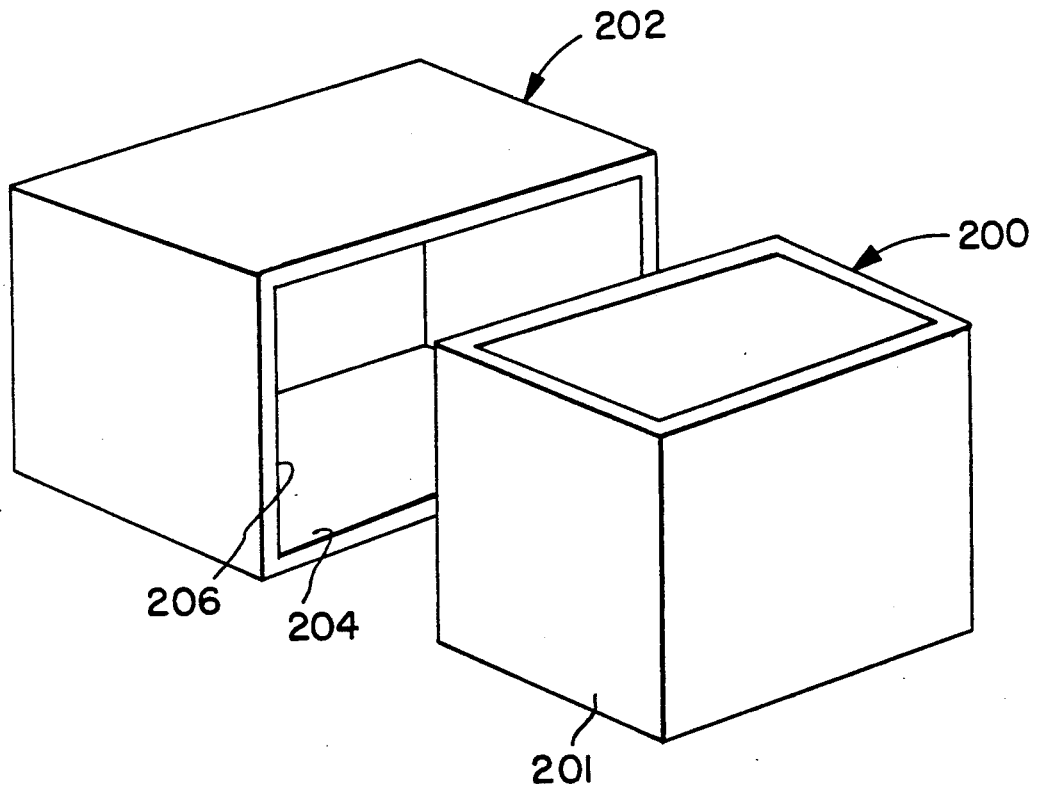
FIG. 5 illustrates top and bottom sections of a carton before assembly.

Referring to FIG. 4, it can be seen that the ramp portion 4, which accommodates the top section 202 of the carton, is slightly recessed with respect to ramp section 3, which accommodates the bottom section 200. The recessed nature of ramp portion 4 serves to position the inner surface 204 of section 202 at or below the surface of ramp portion 3, and thus functions to guide the bottom section 200 into the top section 202 during carton assembly. In a similar manner, backstop 10 is set back with respect to backstop 9, as shown in FIG. 2, to properly position the inner end surface 206 of top section 202 with respect to the outer end surface 201 of bottom section 200. The recessed nature of members 4 and 10 eliminates the need for any moving guide members.

Pusher assembly 100 is provided to insert the bottom section 200 of each carton into the top section 202. The pusher assembly 100 consists of a pneumatic cylinder 101 into which a piston 104 is slidably received. The pneumatic cylinder 101 is located above the surface of the ramp portions 3 and 4 and extends transversely from the outside lateral edge of the first ramp portion 3. A pusher 105 is fixedly attached to piston 104 at a reinforcing plate 106. The pusher 105 has a first vertically extending longitudinal edge located proximate the backstops, and a second vertically extending longitudinal edge located remote form the backstop. In the initial position shown in FIGS. 1, 2, and 4, the pusher is located near the outside lateral edge of first ramp portion 3. The pneumatic cylinder is of the reversible type with pneumatic hoses 116, 117, and 118 which supply working pneumatic fluid to the cylinder. The cylinder is selectively actuated by a switching unit 103 via electrical line 115 in a manner discussed in detail below. The cylinder 101 is supported on the frame of the machine by support member 102.

The cylinder is further supported by side guide member 107, which is attached at one end to the second longitudinal end of pusher 105. Side guide member 107, which extends in parallel with cylinder 101, is slidably supported on support bracket 108 and is attached to the reinforcing plate 106 at the outside edge of the pusher 105. Cam rollers 109, 110, are positioned on top of and to the inside of side guide member 107 for allowing longitudinal movement of the side guide member 107 while preventing lateral or vertical movement thereof. In a similar manner, cam rollers 111 and 112, located beneath side guide member 107 (FIG. 3), support the side guide member 107 while simultaneously facilitating longitudinal movement. By virtue of its position on the outer edge of the pusher 105, The side guide member 107 also functions as a stop when the pusher is in the position shown in broken lines in FIG. 2 for preventing carton sections from entering the work area until the pusher is fully withdrawn.

Limit switches 11 and 12 are inserted in the backstops 9 and 10 of the machine, and a further limit switch 113 is positioned on bracket 108 and normally contacts side guide member 107. The control unit 13 receives signals from limit switches 11, 12, and 113, and actuates pusher 100 based upon the signals received from the limit switches.

In operation, carton bottoms and tops 200 and 202 are conveyed to the carton set-up machine 1 via separate powered infeed conveyors (not shown). Guide elements 14 and 15, extending from the respective powered infeed conveyors, guide the carton sections onto the respective ramp portions 3 and 4. The carton tops enter ramp portion 4 lying on their sides with their open tops facing ramp portion 3, while the carton bottoms enter ramp portion 3 in an upright position. The guide members 5, 6, and 7 prevent the carton sections from rotating during their travel down the ramp portions 3 and 4. The carton sections continue to move down the ramp portions due to their inertia, due to gravity, and/or due to contact with other carton sections entering the ramp portions from the infeed conveyors.

The top and bottom carton sections 202 and 200 continue sliding over ramp portions 4 and 3 until they reach backstops 10 and 9 and actuate respective limit switches 12 and 11. Control unit 13 will actuate the pusher assembly 100 only when both limit switches 11 and 12 have been actuated. Thus, the machine assures that the carton sections are properly aligned before actuating the pusher assembly, without requiring the use of any complicated moving aligning devices.

When both limit switches 11 and 12 have been actuated as described above, control unit 13 will generate an electrical signal which is transmitted via electrical line 115 to switching unit 103. Switching unit 103 then supplies pneumatic pressure to cylinder 101 in such a manner as to move the piston 104, and thus pusher 105 and side guide member 107, from the position shown in solid lines in FIGS. 1, 2, and 4 towards the position shown in broken lines. The pusher 105 pushes the bottom section 200 of the carton across ramp portion 3 and inserts it into the top section 202 without contacting the edges thereof. As previously explained, the recessed nature of ramp portion 4 and backstop 10 assures that the bottom carton section will smoothly slide into the top section. The piston 104 and pusher 105 will continue to move until the bottom carton section is fully inserted into the opening in the top section, and will thereafter slide the set-up carton towards the far end of the set up-machine.

The pusher 105 will continue to move in this manner until it has pushed the set-up carton off from the set-up machine and has reached the fully extended position shown in broken lines in FIGS. 1, 2, and 4. The set-up carton which exits the machine may be manually retrieved or may enter another conveyor and be transported to another work station. Side guide member 107 prevents any oncoming carton section from further movement towards backstops 9 and 10 until the pusher is withdrawn, and thus prevents damage to such an oncoming carton section. When the piston 104 is fully extended, side guide member 107 will also be fully extended to actuate limit switch 113, which will transmit a signal to control unit 13 via electrical line 114. In response to actuation of limit switch 113, which occurs when the end of side guide member 107 moves past switch 113, control unit 13 will cause switching unit 103 to allow the cylinder 104 to withdraw, driving the pusher 105 and the side guide member 107 to the position shown in solid lines in FIGS. 1, 2, and 4. The next carton sections will then slide to backstops 9 and 10 and the cycle will be repeated.

From the foregoing description, it will be appreciated that the operation of the set-up machine helps prevent jamming by delaying operation of the pusher until both sections of the carton are properly positioned against backstops 9 and 10. Furthermore, if either of the carton sections are damaged so that it is not possible to insert the bottom of the carton into the top, the pusher will simply push the disassembled carton off from the set-up machine without jamming the machine and without further damaging the carton sections. The undamaged carton sections can thereafter be retrieved and manually assembled.

While specific embodiments of the invention have been described and illustrated, it will be clear that variations in the details of the embodiments specifically illustrated and described may be made without departing from the true spirit and scope of the invention as defined in the appended claims.

What is claimed is:

1. A carton set-up machine for setting-up a carton having a first carton section and a second carton section, comprising:

a. first and second parallel ramp portions juxtaposed next to one another, wherein each of said first and second ramp portions has a first longitudinal end portion onto which the respective one of the first and second carton sections enter, and wherein each of said first and second ramp portions also has a second longitudinal end portion;

b. guide means, attached to said first and second ramp portions between said first and second longitudinal end portions, for maintaining proper orientation of said first and second carton sections as they travel down the first and second ramp portions towards the respective second longitudinal end portions thereof;

c. backstop means connected to said second longitudinal end portions of said first and second ramp portions for preventing further movement of said first and second carton sections down said first and second ramp portions;

d. sensor means for detecting the presence of said first and second carton sections in positions in which said first and second carton sections are properly positioned for a carton set-up operation;

e. pusher means for inserting said first carton section into said second carton section to thereby form a set-up carton; and f. control means for receiving signals from said sensor means and for actuating said pusher means to insert said first carton section into said second carton section to produce a set-up carton and for actuating said pusher means to eject said set-up carton laterally from said second ramp portion only when said sensor means indicates that both said first and second carton sections are properly positioned for a carton set-up operation.

2. The set-up machine of claim 1, wherein said guide means comprises a first vertical guide member located intermediate said first and second ramp portions, a second vertical guide member attached to said first ramp portion between said first vertical guide member and an outside lateral edge thereof, and a third vertical guide member attached to said second ramp portion between said first vertical guide member and an outside lateral edge thereof.

3. The set-up machine of claim 2, wherein said second and third vertical guide members are laterally adjustable with respect to said first and second ramp portions.

4. The set-up machine of claim 1, wherein said backstop means comprises first and second vertical backstops extending vertically from the second longitudinal ends of said first and second ramp portions, respectively, and wherein said second vertical backstop is longitudinally offset from said first vertical backstop to properly position said second carton section with respect to said first carton section.

5. The set-up machine of claim 4, wherein said sensor means comprises first and second limit switches located in said first and second backstops.

6. The set-up machine of claim 1, wherein said pusher means comprises:

i. a cylinder which is located above the longitudinal surface of said first and second ramp portions proximate said second longitudinal end portions, and which extends transversely from said outside lateral edge portion of said first ramp portion, ii. a piston slidably received in said cylinder;

iii. a pusher connected to said piston at an end remote from said cylinder at an initial position proximate said outside lateral edge of said first ramp portion, wherein said pusher has a first longitudinal end located proximate said backstop means, and a second longitudinal end located between said backstop means and said first longitudinal end of said first ramp portion; and iv. drive means, responsive to signals from said control means, for alternately driving said piston out of and into said cylinder to move said pusher transversely across said first and second ramp portions, whereby said pusher is driven across said first and second ramp portions to insert said first carton section into said second carton section and is subsequently returned to its initial position.

7. The set-up machine of claim 6, wherein said cylinder is a pneumatic cylinder.

8. The set-up machine of claim 1, wherein said second ramp portion is slightly recessed with respect to said first ramp portion to provide proper vertical alignment of said first and second carton sections.

9. The set-up machine of claim 1, wherein said first carton section comprises an upright bottom of a carton, and wherein said second carton section comprises a top of said carton which is lying on its side with its opening facing an inside lateral edge of said first ramp portion.

10. A carton set-up machine for setting-up a carton having a first carton section and a second carton section, comprising:

a. first and second parallel ramp portions juxtaposed next to one another, wherein each of said first and second ramp portions has a first longitudinal end portion onto which the respective one of the first and second carton sections enter, and wherein each of said first and second ramp portions also has a second longitudinal end portion;

b. guide means, attached to said first and second ramp portions between said first and second longitudinal end portions, for maintaining proper orientation of said first and second carton sections as they travel down the first and second ramp portions towards the respective second longitudinal end portions thereof;

c. backstop means connected to said second longitudinal end portions of said first and second ramp portions for preventing further movement of said first and second carton sections down said first and second ramp portions;

d. sensor means for detecting the presence of said first and second carton sections in positions in which said first and second carton sections are properly positioned for a carton set-up operation;

e. pusher means for inserting said first carton section into said second carton section to thereby form a set-up carton, said pusher means comprising i. a cylinder which is located above the longitudinal surface of said first and second ramp portions proximate said second longitudinal end portions, and which extends transversely from said outside lateral edge portion of said first ramp portion, ii. a piston slideably received in said cylinder, iii. a pusher connected to said piston at an end remote from said cylinder at an initial position proximate said outside lateral edge of said first ramp portion, wherein said pusher has a first longitudinal end located proximate said backstop means, and a second longitudinal end located between said backstop means and said first longitudinal end of said first ramp portion, iv. drive means for alternately driving said piston out of and into said cylinder to move said pusher transversely across said first and second ramp portions, whereby said pusher is driven across said first and second ramp portions to insert said first carton section into said second carton section and is subsequently returned to its initial position, and v. a side guide member connected to said pusher at a location proximate said second longitudinal end thereof and extending in parallel with said cylinder past the outside lateral edge of said first ramp portion, and wherein said side guide member is supported at a location remote from said pusher by a plurality of cam rollers, whereby said side guide member supports said pusher and moves with said pusher to act as a stop for preventing carton sections from moving past said pusher until said cylinder is withdrawn; and f. control means for receiving signals from said sensor means and for actuating said drive means to drive said pusher means to insert said first carton section into said second carton section only when said sensor means indicates that both said first and second carton sections are properly positioned for a carton set-up operation.

11. The set-up machine of claim 10, further comprising a limit switch located on said side guide member at a position intermediate said pusher and the end remote from said pusher, and wherein said limit switch sends a signal to said control means when said cylinder and said guide member are fully extended, and wherein said drive means returns said pusher to its initial position when said control means receives said signal from said limit switch.

12. The set-up machine of claim 11, wherein said pusher is operable, when said piston is fully extended, to eject said set-up carton from said second ramp portion.

13. A method of setting-up a carton having a first carton section and a second carton section, comprising the steps of:

a. introducing said first and second carton sections onto first longitudinal ends of first and second parallel ramp portions which are juxtaposed next to one another;

b. guiding said first and second carton sections down said first and second ramp portions;

c. stopping movement of said first and second carton sections at said second longitudinal ends of said first and second ramp portions;

d. detecting the presence of said first and second carton sections at said second longitudinal ends;

e. actuating a pusher means to push said first carton section laterally across said first ramp portion and onto said second ramp portion to insert said first carton section into said second carton section to create a set-up carton only when it is detected that both said first and second carbon sections have reached said second longitudinal ends of said first and second ramp portions; and then f. actuating said pusher means further to eject said set-up carton laterally from said second ramp portion.

14. The method of claim 13, wherein the presence of said first and second carton sections at said second longitudinal ends is detected by the activation of limit switches located at said second longitudinal ends.

15. The method of claim 13, further comprising the step of detecting a fully extended position of said pusher means following said step of actuating said pusher means further, and subsequently withdrawing said pusher means to its initial position.

16. The method of claim 13, wherein said step of introducing first and second carton sections comprises the steps of introducing a first carton section which comprises an upright bottom of a carton, and a second carton section which comprises a top of said carton which is lying on its side with its opening facing an inside lateral edge of said first ramp portion.

17. A carton set-up machine for setting-up a carton having a first carton section and a second carton section, comprising:

a. first and second parallel ramp portions juxtaposed next to one another, wherein each of said first and second ramp portions has a first longitudinal end portion onto which the respective one of the first and second carton sections enter, and wherein each of said first and second ramp portions also has a second longitudinal end portion;

b. guide means, attached to said first and second ramp portions between said first and second longitudinal end portions, for maintaining proper orientation of said first and second carton sections as they travel down the first and second ramp portions towards the respective second longitudinal end portions thereof;

c. backstop which are connected to said second longitudinal end portions of said first and second ramp portions for preventing further movement of said first and second carton sections down said first and second ramp portions;

d. sensors which detect the presence of said first and second carton sections in positions in which said first and second carton sections are properly positioned for a carton set-up operation;

e. a device which inserts said first carton section into said second carton section to thereby form a set-up carton, said device comprising i. a reciprocating member which is located above the longitudinal surface of said first and second ramp portions proximate said second longitudinal end portions and which extends transversely from said outside lateral edge portion of said first ramp portion, ii. a pusher connected to said reciprocating member at an initial position proximate said outside lateral edge of said first ramp portion, wherein said pusher has a first longitudinal end located proximate said backstop means, and a second longitudinal end located between one of said backstops and said first longitudinal end of said first ramp portion, iv. a drive device which drives said reciprocating member to reciprocate to move said pusher transversely across said first and second ramp portions, whereby said pusher is driven across said first and second ramp portions to insert said first carton section into said second carton section to form a set-up carton and is subsequently returned to its initial position, and v. a side guide member connected to said pusher at a location proximate said second longitudinal end thereof and extending in parallel with said cylinder past the outside lateral edge of said first ramp portion, and wherein said side guide member is supported at a location remote from said pusher by a plurality of cam rollers, whereby said side guide member supports said pusher and moves with said pusher to act as a stop for preventing carton sections from moving past said pusher until said cylinder is withdrawn; and f. control means for receiving signals from said sensor and for actuating said drive device to drive said pusher to insert said first carton section into said second carton section only when said sensor means indicates that both said first and second carton sections are properly positioned for a carton set-up operation.

18. The set-up machine of claim 17, further comprising a limit switch located on said side guide member at a position intermediate said pusher and the end remote from said pusher, and wherein said limit switch sends a signal to said control means when said side guide member is fully extended, and wherein said drive means returns said pusher to its initial position when said control means receives said signal from said limit switch, and wherein said pusher is operable, when said piston is fully extended, to eject said set-up carton from said second ramp portion.

19. The set-up means of claim 17, wherein said control means actuates said pusher means further to eject said set-up carton laterally from said second ramp portion.

* * * * *